US005365808A

United States Patent [19]

Palmer

[11] Patent Number: 5,365,808

[45] Date of Patent: Nov. 22, 1994

[54] OIL FILTER SHUT OFF VALVE WRENCH AND METHOD

[76] Inventor: Michael A. Palmer, P.O. Box 1166, Marina, Calif. 93933

[21] Appl. No.: 158,453

[22] Filed: Nov. 29, 1993

[51] Int. Cl.[5] ..... B25B 13/02

[52] U.S. Cl. ..... 81/176.1; 81/176.15

[58] Field of Search ..... 81/176.1, 176.15, 176.2, 81/176.3, 461, 489, 177.1, 3.15

[56] References Cited

U.S. PATENT DOCUMENTS

| | | | |
|---|---|---|---|
| 4,059,033 | 11/1977 | Johnson | 81/176.1 X |
| 4,420,012 | 12/1983 | Aström | 137/319 |
| 4,643,053 | 2/1987 | Rhodes | 81/90.3 |
| 4,836,065 | 6/1989 | Setliff | 81/124.2 |
| 4,964,330 | 10/1990 | Swinney et al. | 81/64 |
| 5,003,848 | 4/1991 | Ceccucci, Jr. | 81/176.2 |

*Primary Examiner*—D. S. Meislin
*Attorney, Agent, or Firm*—Rhodes & Ascolillo

[57] ABSTRACT

In a preferred embodiment, an oil filter shut off valve wrench for use in rotating an engine oil filter assembly of the type requiring rotation thereof to shut off the supply of oil thereto, the oil filter assembly including an oil filter housing attached to an oil filter sleeve by bolts, the oil filter shut off valve wrench including an upwardly open, U-shaped frame member, and an inverted T-shaped handle mechanism attached to the frame member. The present invention also provides a method of shutting off oil supply to the aforementioned engine oil filter assembly.

3 Claims, 5 Drawing Sheets

OIL FILTER SHUT OFF VALVE WRENCH AND METHOD

BACKGROUND OF THE INVENTION

1. Field of the Invention

The present invention relates to engine oil filters generally and, more particularly, but not by way of limitation, to a novel wrench and method for use with the type of oil filter that has a sleeve that must be rotated to shut off the oil supply to the filter before the filter element can be changed.

2. Background Art

Some types of engine oil filter assemblies, such as those employed on the H-60 and S-70 Sikorsky helicopters, have sleeves that must be rotated to shut off the oil supply to the filter before the filters can be disassembled and the filter elements therein changed. Heretofore, there has existed no special tool to accomplish the necessary rotation and the mechanic has been forced to use a pair of pliers or a screwdriver in a makeshift manner. This often damages the sleeves so that both the sleeve and the filter have to be replaced. This creates additional expense in maintaining the helicopters and also forces them out of service until this difficult and time consuming repair can be made.

A number of devices have been developed for use with oil filters and other items that require opening and closing, as follows:

U.S. Pat. No. 4,420,012, issued Dec. 13, 1983, to Astrom, describes a device for use in connection with tapping or filling a container, the device including a housing which is temporarily attached over an opening in the container, the opening being closed by a plug. The housing has a nipple extending therefrom for the passage of a fluid in or out of the housing. A T-handle has a shaft extending through the end of the housing and, at the inside end of the shaft, is a pin which engages a recess in the plug so that the plug may be removed from and reinserted in the opening by rotating the handle.

U.S. Pat. No. 4,643,053, issued Feb. 17, 1987, to Rhodes, describes a tool for removing canister type oil filters, the tool being in the form of a cup with spring biased cam rollers which tighten and grip the surface of the canister when the tool is rotated with a wrench.

U.S. Pat. No. 4,836,065, issued Jun. 6, 1989, to Setliff, describes a radiator cap removal tool which includes a T-handle with a shaft. Disposed at the end of the shaft is a downwardly open cup shaped member with cutouts in the sides thereof to accommodate the ears of the radiator cap.

U.S. Pat. No. 4,964,330, issued Oct. 23, 1990, to Swinney et al., describes a tool for a canister type oil filter, the tool being temporarily attached to the canister by means of a hose clamp, for example. The tool includes outwardly extending members that can be manually gripped by a user to rotate and install or remove the oil filter.

None of the above devices is suitable for use with the type of oil filter requiring rotation of a sleeve to turn off the supply of oil to the filter.

Accordingly, it is a principal object of the present invention to provide a too and method for use in rotating an oil filter of the type requiring rotation of a sleeve to shut off the supply of oil to the filter.

It is a further object of the invention to provide such a tool and method that are easily employed.

It is an additional object of the invention to provide such a tool that is economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an oil filter shut off valve wrench for use in rotating an engine oil filter assembly of the type requiring rotation thereof to shut off the supply of oil thereto, the oil filter assembly including an oil filter housing attached to an oil filter sleeve by means of bolts, the oil filter shut off valve wrench comprising a frame member and a handle means attached to the frame member. The frame member is an upwardly open, U-shaped frame comprising a base member, first and second spaced apart, parallel, vertical side members proximally attached to the base member, a first flange attached to a distal outer edge of the first side member, the flange extending outwardly from the first side member, and a second flange attached to a distal outer edge of the second side member, the flange extending outwardly from the second side member. The frame member further comprises an opening, vertically defined through each of the flanges, the opening sized to accommodate therein the bolts. The handle means comprises an inverted T-shaped grasping member, the grasping member having horizontal grasping member and a vertical grasping member fixedly attached to the median of the horizontal grasping member.

The present invention also provides a method of shutting off oil supply to an engine oil filter assembly of the type requiring rotation thereof to shut off the supply of oil thereto, the oil filter assembly including an oil filter housing attached to an oil filter sleeve by means of bolts inserted into holes defined in the oil filter sleeve, the method comprising removing the bolts from the holes, aligning openings defined in a wrench with the holes, reinserting the bolts into the openings and the holes so as to attach the wrench to the oil filter assembly, and rotating the wrench attached to the oil filter assembly so as to shut off the oil supply to the oil filter assembly.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
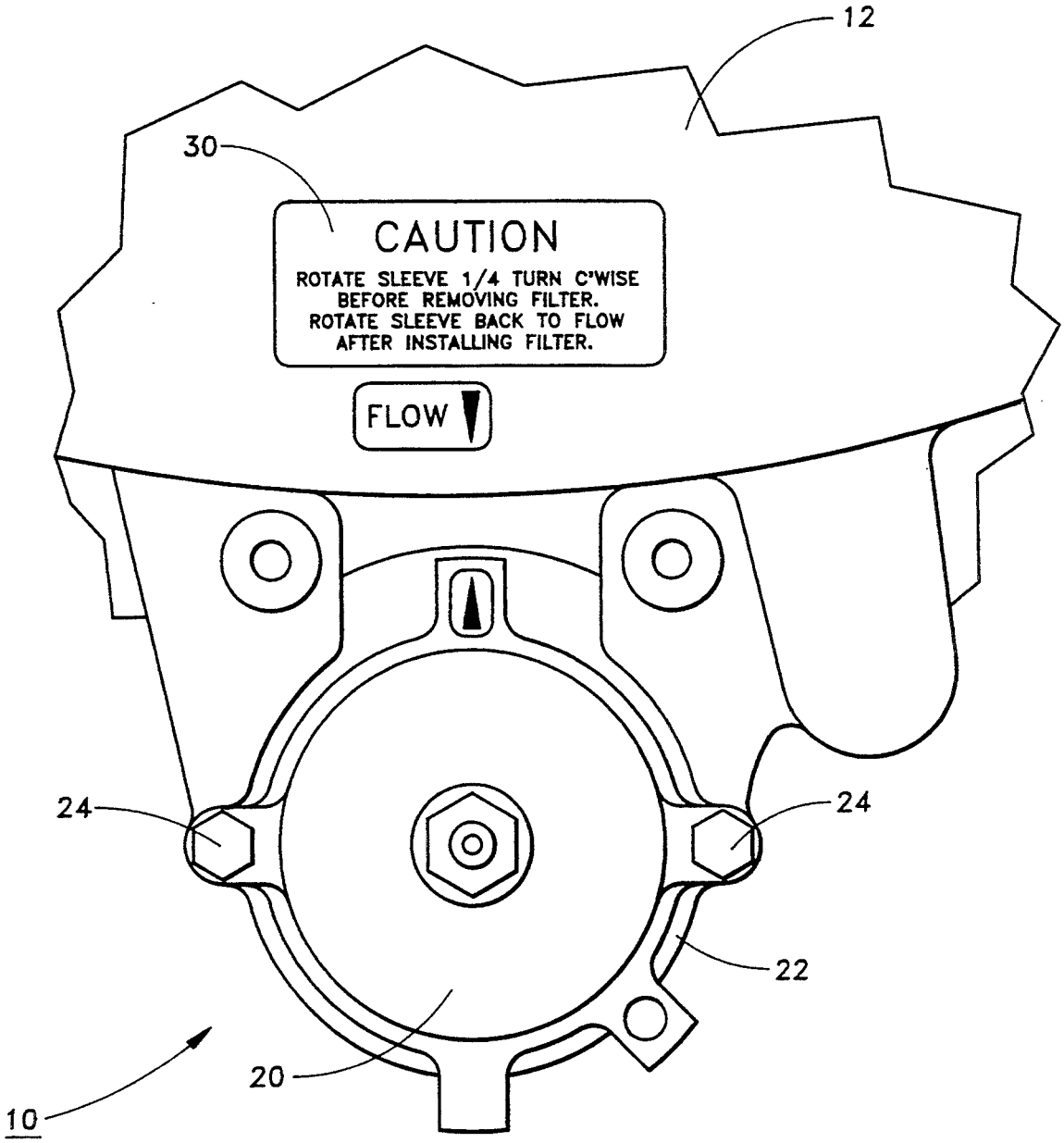
FIG. 1 PRIOR ART
FIG. 1 is bottom plan view of an oil filter installation for which the tool of the present invention is intended.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
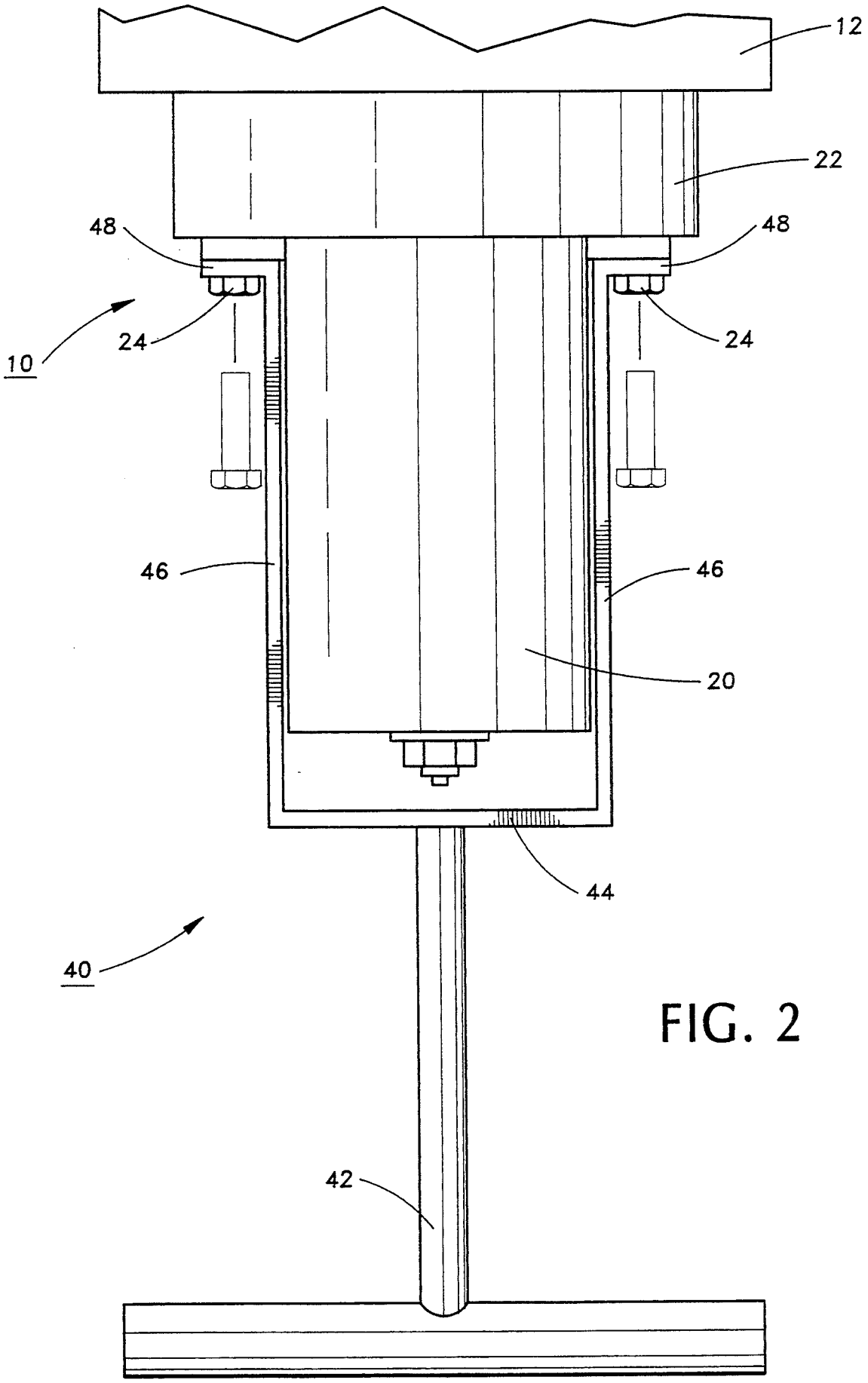
FIG. 2 is a side elevational view of the oil filter with the tool of the present invention in operating position.

Referring first to FIGS. 1 and 2 together, there is illustrated an oil filter assembly, generally indicated by the reference numeral 10, which oil filter assembly is of the type with which the tool of the present invention is used, the oil filter assembly being shown attached to a portion of an engine 12.

Oil filter assembly 10 includes a cylindrical filter housing 20 having a closed bottom end and an open top end, the latter being attached to a filter sleeve 22 by means of bolts 24 threadingly inserted into bolt holes (not shown). A valve (not shown) is disposed internally of oil filter sleeve 22. As is noted on the "CAUTION" message 30 (FIG. 1) on engine 12, sleeve 22 must be rotated one-quarter turn clockwise viewed from the bottom of cylindrical filter housing 20 to close the valve and to shut off the oil flow to oil filter assembly 10 before the filter is removed.

Figure 3:
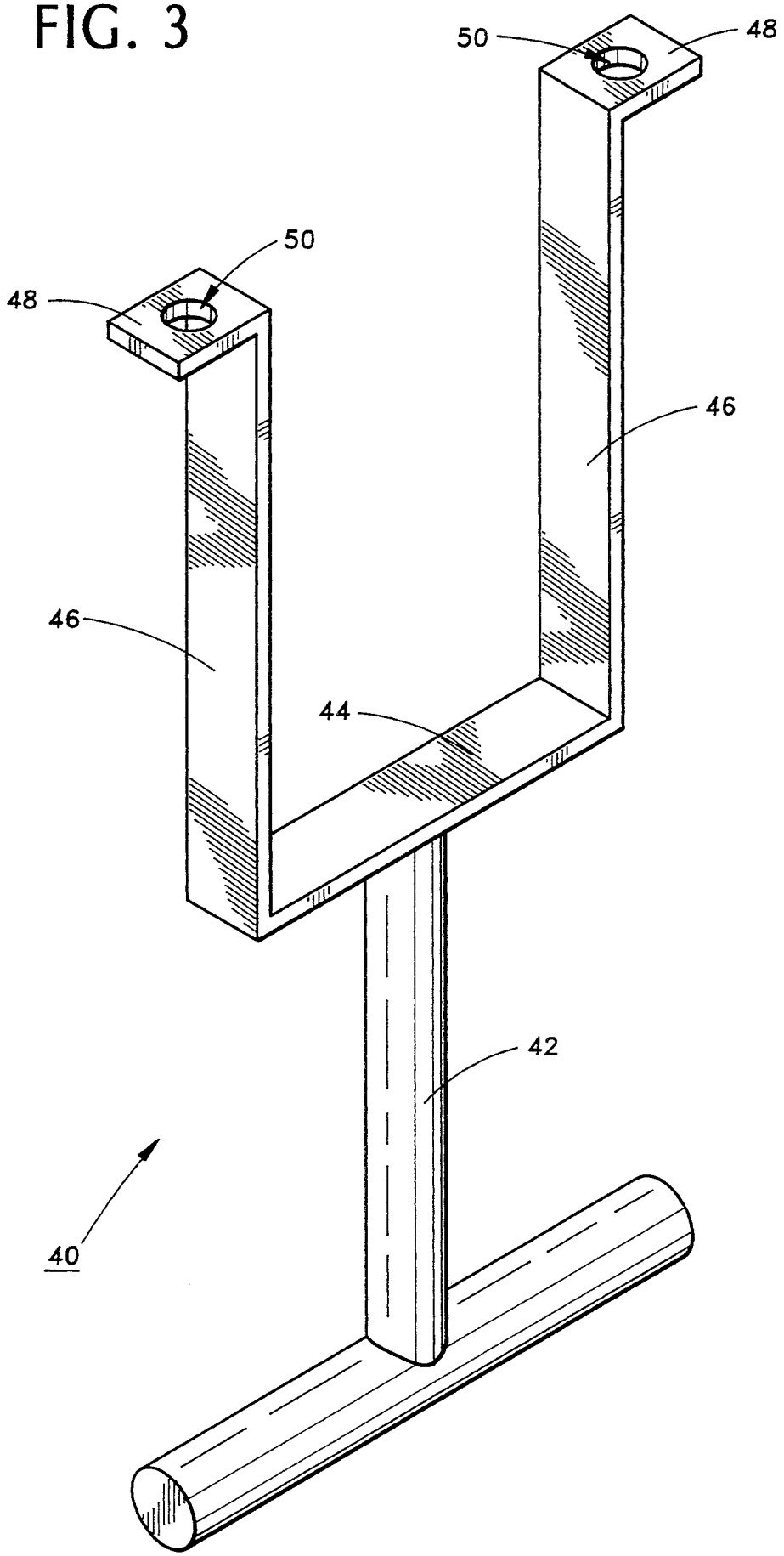
FIG. 3 is an isometric view of the tool of the present invention.

Referring now to FIGS. 2 and 3 together, there is illustrated a oil filter shut off valve wrench according to the present invention, generally indicated by the reference numeral 40. Wrench 40 includes a T-handle 42 at the distal end thereof attached to a horizontal base member 44. Proximally attached to the ends of base member 44 are two, spaced apart, parallel, vertical side members 46, the base member and the side members comprising an upwardly open, U-shaped frame, with the side members 46 being spaced sufficiently apart so as to accommodate therebetween oil filter housing 20 and being sufficiently long enough to extend at least to the length of the oil filter housing. Attached to and extending horizontally outwardly from the distal ends of each side member 46 is a flange 48 having vertically defined therethrough an opening 50 sized to accommodate therein a bolt 24.

In use, and with reference to FIG. 2, wrench 40 has been attached to oil filter assembly 10 by removing bolts 24 from the oil filter sleeve 22, aligning openings 50 with the bolt holes in the sleeve 22, and replacing and tightening the bolts.

Figure 4:
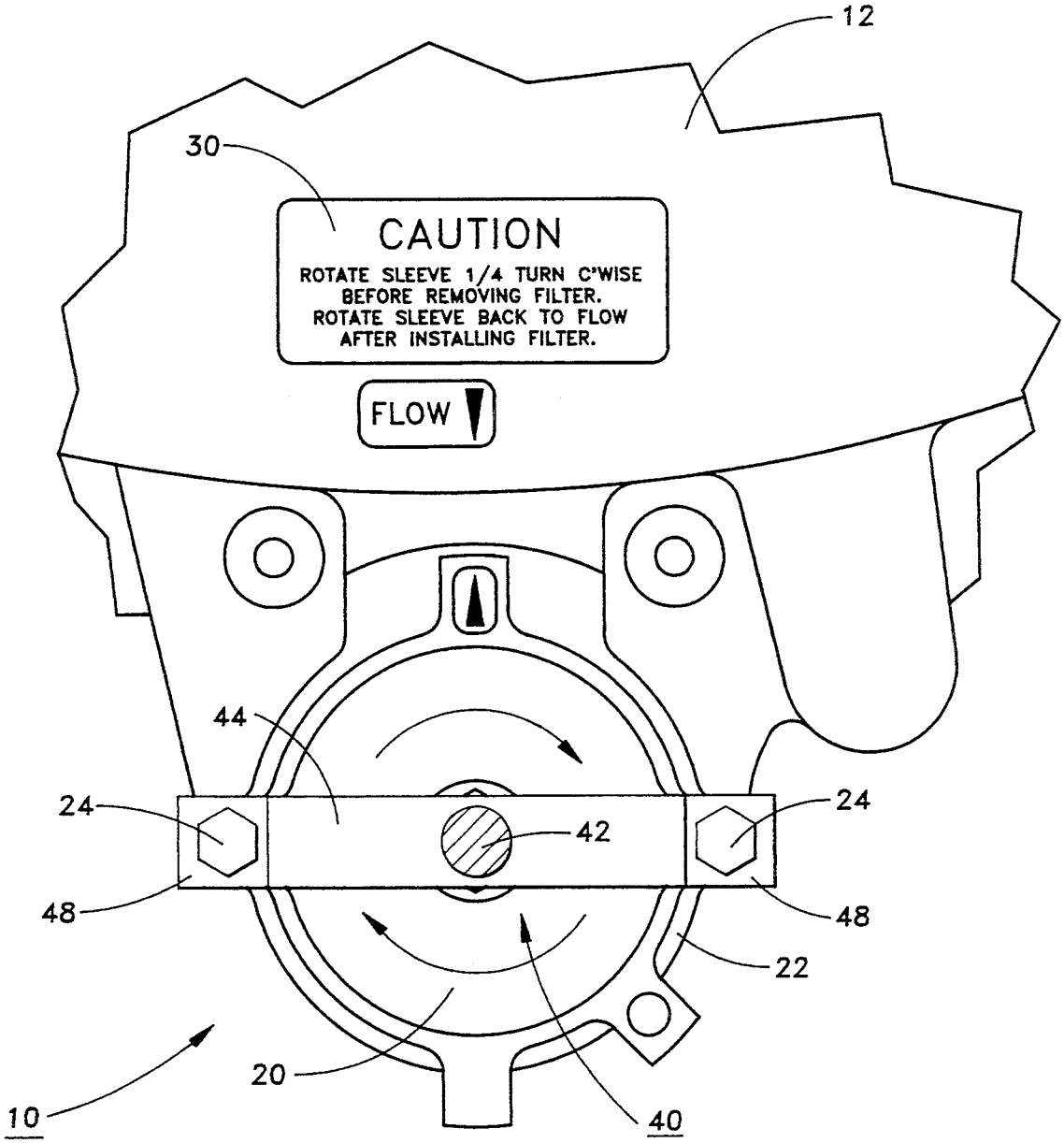
FIGS. 4 and 5 are bottom plan views, partially in cross-section, of the oil filter with the tool of the present invention attached thereto, illustrating the use of the tool.
Figure 5:
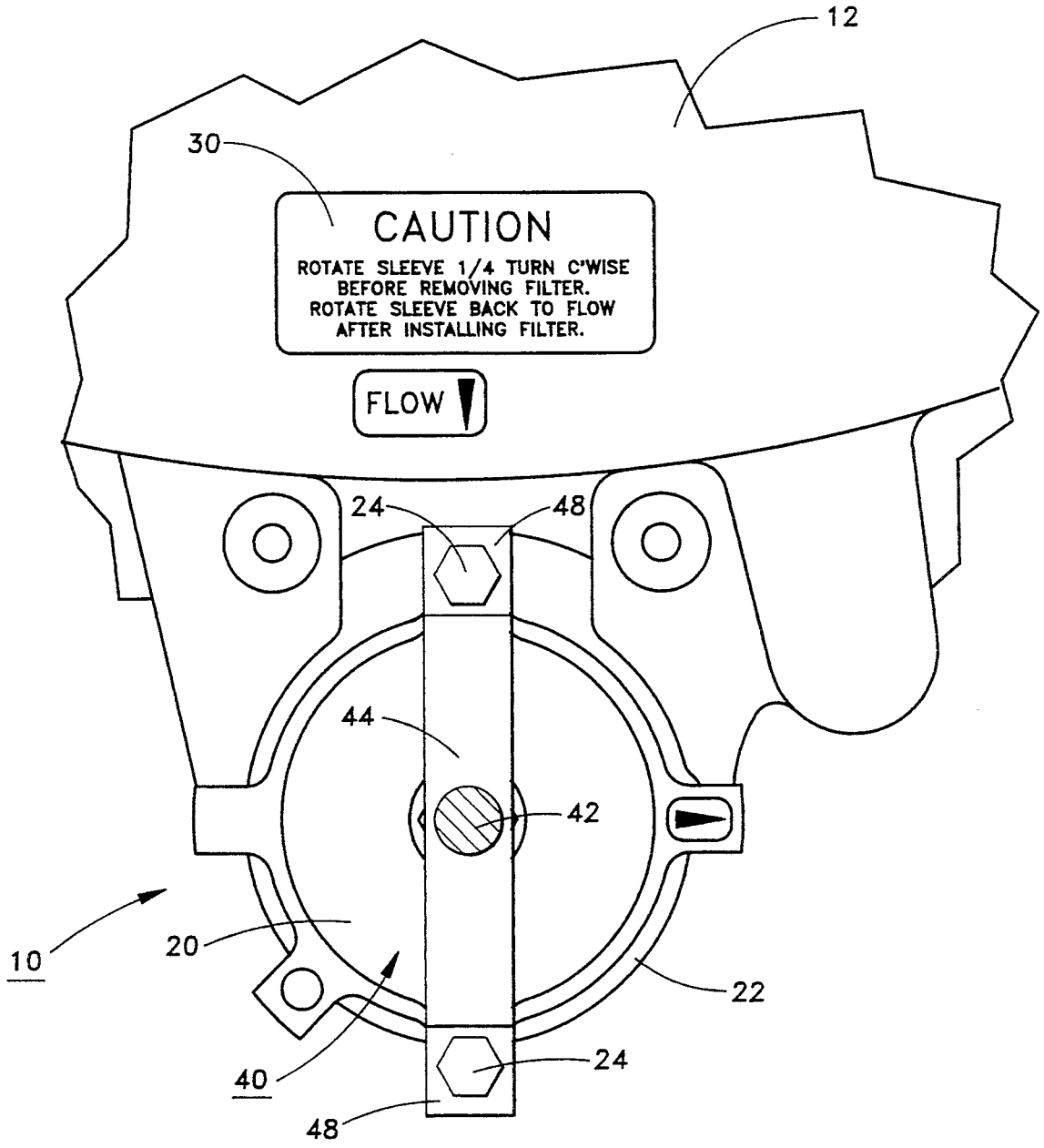

Referring to FIG. 4, wrench 40 is shown attached to oil filter assembly 10, with the oil filter assembly in "FLOW" position such that oil is supplied to the oil filter assembly. Manually grasping and rotating wrench 40, which has been attached to oil filter assembly 10, one-quarter turn in the direction of the arrows to the position shown on FIG. 5 closes the valve in oil filter sleeve 22 and shuts off the supply of oil to the oil filter assembly 10. Bolts 24 and wrench 40 are then removed, oil filter housing 20 is removed, and the oil filter elements therein (not shown) are replaced. Oil filter housing 20 is then placed on oil filter sleeve 22, wrench 40 is bolted to oil filter assembly 10 as shown on FIG. 5, and the wrench is rotated one-quarter turn counterclockwise to restore the flow of oil. Finally, wrench 40 is removed and bolts 24 are reattached to secure oil filter housing 20 to oil filter sleeve 22. The whole process proceeds without danger of damage to oil filter assembly 10.

Wrench 40 may be easily and economically fabricated from any suitable material, such as steel.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An oil filter shut off valve wrench for use in rotating an engine oil filter assembly of the type requiring rotation thereof to shut off the supply of oil thereto, said oil filter assembly including an oil filter housing attached to an oil filter sleeve by means of bolts, said oil filter shut off valve wrench comprising:

(a) an upwardly open, U-shaped frame comprising:
- a base member;
- two, spaced apart, parallel, vertical side members proximally attached to said base member;
- a flange perpendicularly attached to each of the side members; and
- a circular opening, defined through each of said flanges, said circular opening sized to accommodate therein said bolts; and (b) an inverted T-shaped handle.

2. An oil filter shut off valve wrench for use in rotating an engine oil filter assembly of the type requiring rotation thereof to shut off the supply of oil thereto, said oil filter assembly including an oil filter housing attached to an oil filter sleeve by means of bolts, said oil filter shut off valve wrench comprising:

(a) an upwardly open, U-shaped frame comprising:
- a base member;
- two, spaced apart, parallel, vertical side members proximally attached to said base member;
- a flange perpendicularly attached to each of the side members; and
- a circular opening, defined through each of said flanges, said circular opening sized to accommodate therein said bolts; and (b) an inverted T-shaped handle attached to the frame member, said handle comprising:
- a horizontal grasping member having a circular cross-section;
- a vertical grasping member, having a circular cross-section, fixedly attached to the median of said horizontal grasping member.

3. An oil filter shut off valve wrench, as defined in claim 2, wherein said vertical side members have a substantially rectangular cross-section.

* * * * *